United States Patent [19]

Ingelmann et al.

[11] Patent Number: 4,543,802

[45] Date of Patent: Oct. 1, 1985

[54] EVAPORATING APPARATUS

[75] Inventors: Hans-Joachim Ingelmann, Iggingen-Schönhardt; Hans Kampf, Stuttgart, both of Fed. Rep. of Germany

[73] Assignee: Süddeutsche Kühlerfabrik Julius Fr. Behr GmbH & Co. KG, Stuttgart, Fed. Rep. of Germany

[21] Appl. No.: 627,561

[22] Filed: Jul. 3, 1984

[30] Foreign Application Priority Data

Jul. 28, 1983 [DE] Fed. Rep. of Germany ..... 3327179

[51] Int. Cl.[4] ..... F25B 39/02

[52] U.S. Cl. ..... 62/525; 62/511

[58] Field of Search ..... 62/525, 527, 511

[56] References Cited

U.S. PATENT DOCUMENTS 2,084,755 6/1937 Young, Jr. ..... 62/525

*Primary Examiner*—William E. Wayner

*Assistant Examiner*—John Sollecito

*Attorney, Agent, or Firm*—Barnes & Thornburg

[57] ABSTRACT

An evaporator apparatus comprises an evaporator assembly to which a coolant is supplied by an expansion valve and a flow divider. The connecting means between the expansion valve and the flow divider is provided with at least one bend. The bend causes a non-homogeneous coolant flow at the flow divider, resulting in an uneven distribution of gaseous and liquid coolant to the individual evaporator pipe sets. A mixing element, provided directly upstream of the flow divider, has a flow cross-section which expands in the direction of the coolant flow, resulting in a brisk mixing of the gaseous and liquid coolant phases to provide a homogeneous mixture. Preferred embodiments of this mixing element include a cylindrical mixing cell having a preferred inlet diameter/cell diameter ratio, a tapered insert which first decreases and then increases the flow cross-section, and a simple screen. The two latter embodiments may be installed in pipes which have constant diameters.

15 Claims, 12 Drawing Figures

EVAPORATING APPARATUS

BACKGROUND AND SUMMARY OF THE INVENTION

This invention relates to an evaporator apparatus, especially for air-conditioning units of motor vehicles, which includes an evaporator assembly having several evaporator pipes, and a coolant feeding system comprising an expansion valve, a flow divider for dividing the coolant flow, and connecting means such as a pipe, which connects the expansion valve to the flow divider and which has at least one bend.

Evaporator apparatuses of this type are known in principle. They include a thermostatically controlled expansion valve that is supplied with coolant. A flow divider is arranged downstream of the expansion valve to distribute the coolant flow evenly to various sets (i.e., series connected groups) of evaporator pipes. The actual evaporation then takes place in the evaporator assembly.

The heat exchange surface of the evaporator assembly will be used optimally only when the coolant evaporates completely at the end of all parallel evaporator pipe sets and is overheated by an amount that is equally large in all sets. This overheating is used as the regulating variable for the control of the coolant flow by one or several thermostatic expansion valves.

The flow divider is designed so as to evenly distribute the coolant flow to the different sets of evaporator pipes. In a conventional embodiment, a Venturi distributor is used which divides the coolant flow to corresponding circular segments (see U.S. Pat. No. 2,803,116). To ensure that the coolant is admitted uniformly to the various sets of evaporator pipes, it is essential that a homogeneous two-phase (liquid/gas) flow exists at the inlet of the flow divider. If the flow is asymmetrical or non-homogeneous, different amounts of coolant are admitted to each set of pipes which impairs the efficiency of the evaporator and, under certain circumstances, may also result in unsatisfactory control of the coolant flow by the thermostatic expansion valves.

In order to obtain an even coolant flow at the inlet of the flow divider, relatively long steadying sections are often provided immediately upstream of the inlet. Vertically rising or falling steadying sections have proven to be especially advantageous.

However, under cramped mounting conditions, such as exist in motor vehicles, it is not possible to use such steadying sections. Because of sealing problems at the evaporator housings, it is also not possible, in this situation, to mount the flow divider directly behind the expansion valve (which would result in a somewhat more satisfactory division of the coolant flow). It is often necessary to use a bent or spiral-shaped connecting means between the expansion valve and the flow divider. Under these conditions, because of the different inertia of the gaseous coolant and the liquid coolant, there is a separation of the two phases and a development of rotational flows. Since these asymmetric rotational flows are divided into circular segments by the flow divider, certain sets of evaporator pipes are flooded with liquid coolant, while other sets are predominantly filled with gaseous coolant and contribute little to the heat exchange process. The efficiency of the evaporating apparatus is therefore severely impaired. Additionally, as noted above, the performance of the evaporating apparatus is further impaired due to the control characteristics of the thermostatic expansion valves under these conditions.

It is an object of this invention to provide an evaporator apparatus of the above-mentioned type in which a bent or spiral-shaped connecting means can be used between the expansion valve and the flow divider, while nevertheless providing a homogeneous two-phase flow at the inlet of the flow divider.

This object is achieved in an evaporating apparatus of the above type by providing a mixing element arranged directly in front (i.e., upstream) of the flow divider in the coolant flow path. The flow cross-section of the mixing element expands suddenly in the direction of the coolant flow. Due to the expansion of the flow cross-section, a rapid expansion of the two-phase flow (i.e., the gaseous coolant and the liquid coolant), is achieved so that these two phases are mixed together. The result is a flow which is a homogeneous mixture of liquid and gaseous coolant. When the flow divider divides this homogeneous liquid/gas flow into different circular segments, it is ensured that each set of evaporator pipes receives a homogeneous mixture of equal characteristics. This improves the efficiency, as well as the control, of the evaporating apparatus.

The point at which the two-phase flow enters into the mixing element is at a slightly reduced pressure level. Thus, mixing takes place adiabatically (i.e., without a supply of heat from the environment). Therefore, the efficiency of the evaporator apparatus is not reduced by the installation of a mixing element according to this invention. Additionally, the slight drop in pressure across the mixing element does not impair the function or the efficiency of the expansion valves. Finally, no special manufacturing conditions or tolerances are required—with the exception of the general requirements for cooling equipment, regarding resistance to pressure, tightness, and cleanliness—so that the evaporator apparatus of the present invention can be manufactured at costs that are not much higher than those of known evaporator apparatuses.

In a preferred embodiment, the mixing element comprises a cylinder-shaped mixing cell, the diameter $d_W$ of which is larger than the diameter $d_E$ of the entry opening for the coolant flow. It has been found to be especially advantageous if the ratio $d_E/d_W$ is at least $\frac{1}{2}$ and no more than $\frac{2}{3}$.

It is preferred to arrange the entry opening for the coolant flow on the cylinder shell (i.e., sidewall) of the mixing cell. In this case, the rapid expansion of the two-phase flow and the mixing of the gaseous and liquid coolant is further assisted by the impact of the liquid particles on the cylinder wall opposite the entry opening.

The flow divider may be placed directly at the opening of the mixing cell. Thus, no additional connecting means is required between the mixing cell and flow divider. It is preferred to also locate the opening for the flow divider on the cylinder shell of the mixing cell.

The mixing element may also be constructed differently. It may, for example, take the form of an insert having a cross-section that at first tapers in the flow direction. After this tapering, the cross-section expands again in the flow direction, resulting in the above-mentioned mixing to produce the homogeneous liquid/gas flow. Since the tapering occurs first, this insert can be installed in a pipe or between two pipes which have constant diameters. A change in the cross-section of these pipes is therefore not required.

It is also possible to fasten a tapered insert to the inside of one or several pipes, such that the expansion of the flow cross-section is located at the downstream end of the tapered part of the insert where the flow discharges into the pipe. In this case, the insert is very simple in construction and can be installed in pipes having the same diameters. It is especially preferred to provide this insert with a collar which extend around its circumference and which rests against the ends of two pipes (i.e., the collar is held between the opposing pipe ends). For increased sealing effect, one of these pipes may additionally be provided with an enlarged end which overlaps the collar.

In yet another embodiment, the mixing element may simply consist of a screen. This screen, in a manner similar to that of the collar mentioned above, may be fastened between the ends of two pipes.

Another application of the invention is in evaporator apparatuses where the coolant connections from the flow divider to the pipe sets must be located on a certain side of the apparatus. Since the suction pipes (i.e., the pipes accepting the discharge of the gaseous coolant) are located on the downstream end of the evaporator apparatus, each evaporator pipe set has an uneven number of pipes. Frequently, the number of evaporator sets (i.e., the number of coolant inputs) is even, requiring an even number of pipes in the evaporator assembly, because the even number of evaporator sets multiplied by the uneven number of pipes per set results in an even number. However, the evaporator assemblies are often constructed in such way that they contain an uneven number of pipes. In this case, one pipe remains empty.

This is best explained by means of an example: It is assumed that an evaporator assembly is nine pipes wide and five pipes deep, for a total of 45 pipes. The coolant input is of a quadruple design, resulting in four evaporator sets. Thus, each of these evaporator sets has 11 pipes, so that $4\times 11=44$ pipes are required. The 45th pipe remains empty.

Because of the high gas velocities and the resulting high pressure drops, the suction pipe to the compressor cannot be connected, via the empty pipe in the evaporator apparatus, to the connection side of the evaporator. However, by means of the present invention, it becomes possible to use this empty pipe as the connecting means between the expansion valve and the flow divider. The expansion valve is therefore located on the side of the evaporator assembly that faces away from the connection side, with the empty pipe connecting this expansion valve to the connection side. On the connection side, a mixing element according to the present invention is provided to ensure a homogeneous liquid/gas flow to the inlet of the flow divider. This arrangement does not reduce the performance of the evaporator apparatus. By so utilizing the empty pipe in the evaporator assembly, the need for routing an evaporating apparatus connection means around the evaporator assembly is avoided. The routing of such connection means can be especially difficult, or even impossible, in cramped spaces.

Further objects, features, and advantages of the present invention will become more apparent from the following description when taken with the accompanying drawings which show, for purposes of illustration only, a preferred embodiment in accordance with the present intention.

DETAILED DESCRIPTION OF THE DRAWINGS

Figure 1:
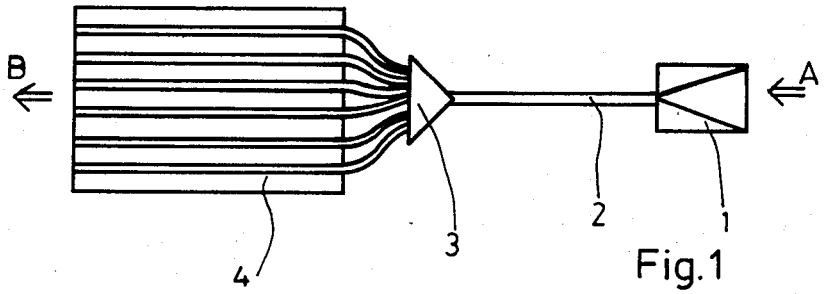
Fig.1 PRIOR ART
FIG. 1 shows an evaporator apparatus having a steadying section provided in front of the flow divider for obtaining a homogeneous liquid/gas flow, said steadying section being impossible to provide under cramped mounting conditions.

In FIG. 1, an expansion valve is indicated by reference numeral 1. The coolant enters into expansion valve 1 from the direction of the arrow A. Expansion valve 1 is a thermostatic expansion valve, where the overheating of the gaseous coolant in the evaporator pipes is used as a variable for regulating coolant flow. Via a steadying section 2, expansion valve 1 is connected with a flow divider 3 which divides the flow symmetrically. In this case, a flow divider is used which divides the coolant flow into circular segments. An example of such a flow divider is the Venturi distributor shown in U.S. Pat. No. 2,803,116. The steadying section 2 provides a homogeneous, two-phase liquid/gas flow (i.e., a centric ring flow) to the inlet of flow divider 3 so that flow divider 3 distributes to each of the evaporator pipe sets a partial coolant flow having the same characteristics.

The outlets of flow divider 3 are connected to evaporator assembly 4, which has a number of evaporator pipes. Several of these evaporator pipes are connected to form a set of evaporator pipes so that each of the partial coolant flows originating from flow divider 3 flows through evaporator assembly 4 several times. Optimally, the coolant should be evaporated completely at the end of each evaporator pipe set and should be overheated by an amount that is equally large in all sets. This overheating is used as a variable for the control of the coolant flow by expansion valve 1. Subsequently, the gaseous coolant leaves the evaporator assembly, in the direction of arrow B, and is routed to the compressor by a suction pipe (not shown).

It can be shown that uniform evaporation and overheating of the coolant in the evaporator assembly can be ensured only if a homogeneous liquid/gas flow—or, in the case of a division into circular segments, a centric ring flow—is provided at the inlet of flow divider 3. In the arrangement shown in FIG. 1, steadying section 2 produces such a flow. In the cramped mounting conditions which exist in motor vehicles, it is not possible to provide such a steadying section (which in practical application is not constructed horizontally, as shown here, but rather vertically rising or falling). Therefore, other solutions must be found.

Figure 2:
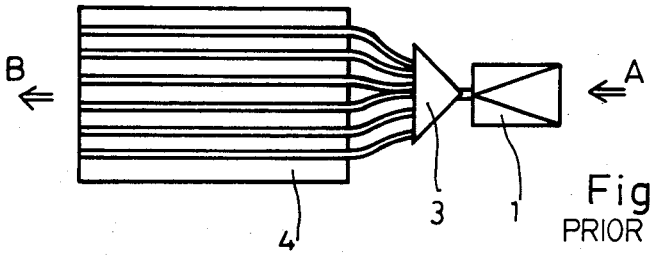
Fig.2 PRIOR ART
FIG. 2 shows an arrangement of an evaporator apparatus which, because of sealing problems at the evaporator housing, is not suitable for practical applications.

An arrangement similar to that of FIG. 1 is shown in FIG. 2. Here, no steadying section is provided since an approximately homogeneous liquid/gas flow exists at the outlet of expansion valve 1. However, this arrangement is not suitable for practical applications because of sealing problems encountered at the evaporator housing.

Figure 3:
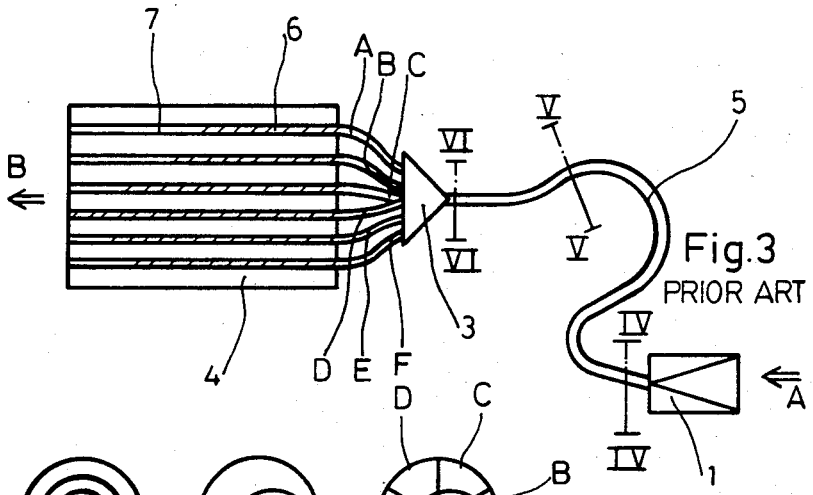
Fig.3 PRIOR ART
FIG. 3 shows a prior art evaporator apparatus having a bent or spiraling connection means between the expansion valve and the flow divider.
Figure 4:
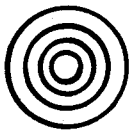
FIGS. 4, 5 and 6 show enlarged sectional views through the connecting means located between the expansion valve and the flow divider shown in FIG. 3, taken along reference lines IV—IV, V—V and VI—VI, respectively.
Figure 5:
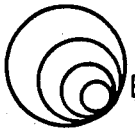
Figure 6:
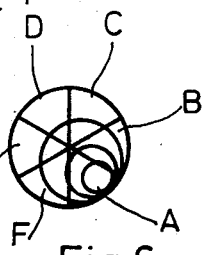

FIG. 3 shows a state-of-the-art arrangement of an evaporator apparatus in cramped mounting conditions. In this arrangement, the coolant enters expansion valve 1 from the direction of arrow A and, from there, is guided to flow divider 3 by a pipe (5) that is bent several times. In this case, the pipe (5) can no longer serve as a steadying section for the reasons illustrated in FIGS. 4, 5 and 6 which show cross-sections taken along reference lines IV—IV, V—V and VI—VI of FIG. 3, respectively. As shown in FIG. 4, immediately downstream of expansion valve 1 there exists a homogeneous liquid/gas flow (i.e., centric ring flow). However, during the passage through the multiply bent pipe 5, rotational flows develop which, as shown in FIG. 5, result in an eccentric ring flow. Therefore, a mixture of gaseous and liquid coolant that is homogeneous over the whole cross-section will no longer exist. If this eccentric ring flow, as shown in FIG. 6, is now divided into circular segments by flow divider 3, the individual evaporator pipe sets will no longer be uniformly supplied with gaseous coolant and liquid coolant. For purposes of illustration, the pipe sets A to F leading to the evaporator assembly corresponding to the circular segments of FIG. 6 are labeled in FIG. 3. Here, it is shown that the evaporator pipe set D receives a large amount of liquid coolant while the other evaporator pipe sets receive correspondingly less liquid coolant. In the arrangement shown, evaporator pipe set A receives the least amount of liquid coolant. The separation of coolant into two-phase (liquid/gas) and single-phase (gas) flows is illustrated in FIG. 3. Referring to pipe set A, the two-phase flow is indicated by reference numeral 6 and the single-phase, or gaseous, flow is indicated by reference numeral 7.

The non-homogeneous distribution of the coolant flow to the individual evaporator pipe sets results in two significant disadvantages. On the one hand, it impairs the efficiency of the evaporating apparatus. On the other hand, the coolant gas, when it leaves the evaporator pipe sets, is not evenly overheated, which results in an unsatisfactory control of the thermostatic expansion valve 1.

Figure 7:
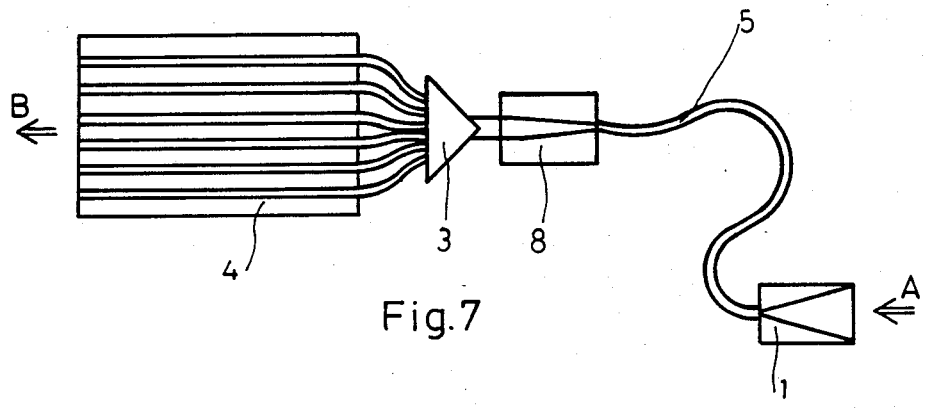
FIG. 7 shows a schematic arrangement of an evaporator apparatus according to the present invention.

The present invention provides, at the inlet to the flow divider, a mixing element having an expanding flow cross-section. The principal features of such an arrangement are shown in FIG. 7. Where appropriate, the reference numbers used in the preceding figures are retained in the figures discussed below. The expansion of the cross-section of mixing element 8, arranged at the inlet of flow divider 3, results in a brisk mixing of the gaseous coolant and the liquid coolant and, thus, provides a homogeneous mixture. The flow divider can now divide the coolant flow into equal partial coolant flows that are conducted to the individual evaporator pipe sets. Thus, evaporation and overheating take place evenly in all evaporator pipe sets, resulting in increased efficiency of the evaporator and better control of the expansion valve. The entry of the liquid/gas flow into the mixing cell, which is at a slightly lower pressure level, and the resulting mixing, takes place adiabatically, i.e., without a supply of heat from the environment. The efficiency of the evaporator is therefore not reduced by installation of the mixing element. The slight pressure drop across the mixing element also does not impair the function or the efficiency of the expansion valves.

Figure 8:
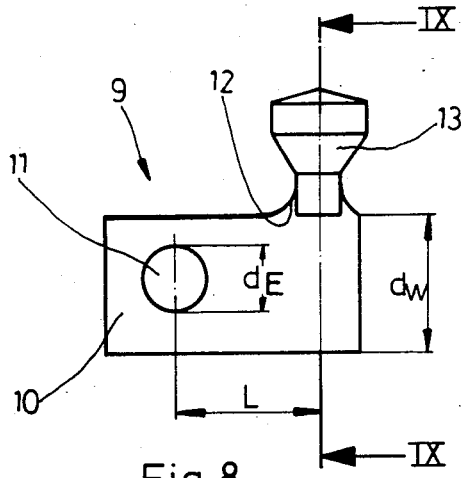
FIG. 8 shows a sectional view through a mixing element, according to the present invention, developed as a mixing cell.

An embodiment of mixing element 8 shown schematically in FIG. 7, is shown in FIG. 8. In this case, the mixing element is designed as a cylinder-shaped mixing cell 9. An entry opening 11 for the coolant flow is arranged on the cylinder shell (i.e., sidewall) 10 of mixing cell 9. The diameter $d_E$ of entry opening 11 is smaller than the diameter $d_W$ of mixing cell 9. The ratio $d_E/d_W$ is preferably between $\frac{1}{2}$ and $\frac{2}{3}$. This results in an expansion of the flow cross-section, resulting in a rapid expansion of the two-phase flow and in a brisk mixing to form a homogeneous mixture. Since entry opening 11 is arranged on cylinder shell 10, the two-phase flow also encounters the cylinder wall that is opposite entry opening 11 which promotes the mixing even further. No special requirements, with regard to the manufacturing quality of the mixing cell, are demanded, apart from the requirements generally made for cooling equipment, such as resistance to pressure, tightness and cleanliness.

An outlet opening 12 is also arranged on the cylinder shell 10. The distance L between entry opening 11 and outlet opening 12 is preferable 25 to 35 mm. To simplify construction, flow divider 13 is connected directly to outlet opening 12, as shown. This further reduces expenditures for components and mounting, and correspondingly reduces manufacturing costs for an evaporator apparatus according to the present invention.

Figure 9:
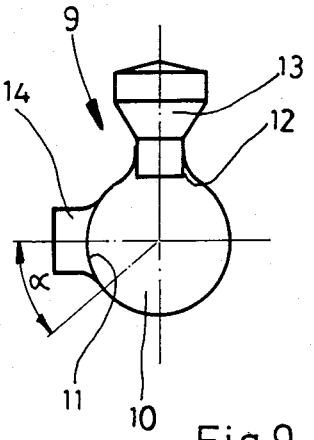
FIG. 9 shows a sectional view through the element shown in FIG. 8 taken along reference line IX—IX.

FIG. 9 shows the cross-section taken along reference line IX—IX of FIG. 8. In FIG. 9, inlet connection 14 is shown positioned over entry opening 11. Inlet connection 14 may be arbitrarily positioned on cylinder shell 10, as shown by angle $\alpha$ which may range between 0° and 360°. The inlet opening can therefore be adapted to different mounting conditions.

Figure 10:
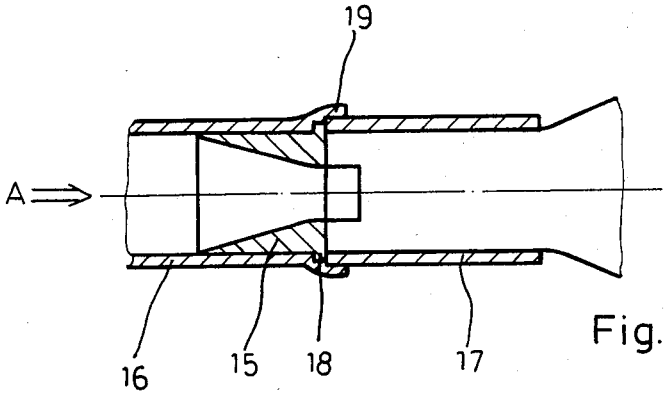
FIG. 10 shows a sectional view through another embodiment of the mixing element.

Another embodiment of a mixing element according to the present invention is shown in FIG. 10. Here, insert 15, which has a cross-section that is tapered in the flow direction, is provided. In this embodiment, the mixing element can be arranged on the inside of pipes 16 and 17, without requiring a change in the cross-section of these pipes.

For fastening insert 15 to pipes 16 and 17, collar 18 extending around the circumference of insert 15 is provided. Collar 18 is positioned against the ends of pipes 16 and 17. This provides for a simple fastening arrangement. Pipe 16 may also be provided with an enlarged end 19 which overlaps collar 18 to provide a simple and reliable seal.

Figure 11:
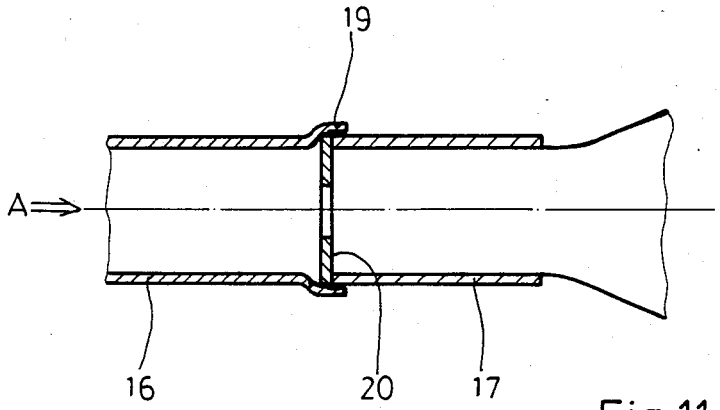
FIG. 11 shows a sectional view through a third embodiment of the mixing element.

The embodiment shown in FIG. 10 may be simplified further, as shown in FIG. 11. Here, the mixing element consists only of a screen 20 which is fastened to pipes 16 and 17 in a manner similar to that of insert 15 in FIG. 10.

Figure 12:
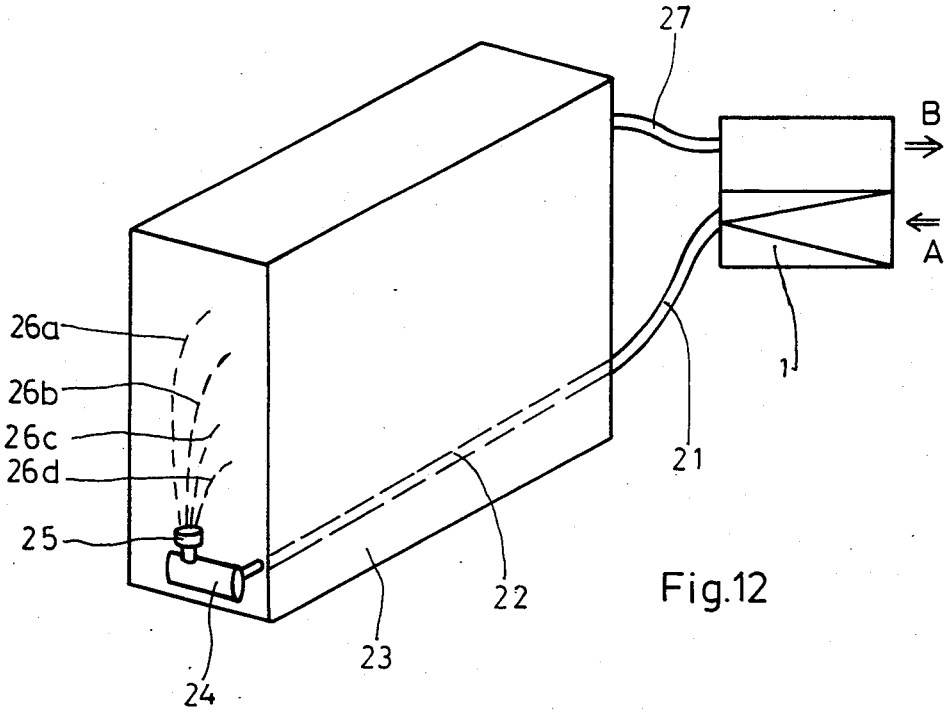
FIG. 12 shows a schematic of an application of the mixing element, according to the present invention, in an evaporator apparatus having an uneven number of pipes and an even number of evaporator pipe sets.

A special application of the invention is shown in FIG. 12. It is known that an evaporator assembly is often equipped with an uneven number of pipes, while the number of evaporator pipe sets, and thus the number of required pipes is even. In this case, one pipe in the evaporator assembly remains empty. Because of the high gas speeds and the resulting high pressure losses, this empty pipe cannot be used as a suction pipe for the compressor. However, because of the present invention, it is possible to use this empty pipe as the connecting means between the expansion valve and the flow divider. A separate connecting means around the evaporator assembly, which is sometimes difficult or impossible to mount, is therefore unnecessary.

As shown in FIG. 12, coolant flows in the direction of arrow A through expansion valve 1 and, via connecting means 21, to empty pipe 22 which is shown in dotted lines. On the connection side of evaporator assembly 23, empty pipe 22 enters the mixing element, shown here as mixing cell 24. After leaving flow divider 25, located on mixing cell 24, coolant flows to the evaporator pipe sets, as schematically illustrated by lines *26a–26d*. After passing through these pipe sets, the gaseous coolant flows, via suction pipe 27, in the direction of arrow B to the compressor which is not shown here.

Although the present invention has been described and illustrated above in detail, it is to be clearly understood that the same is by way of illustration and example only, and is not to be taken by way of limitation. The spirit and scope of the present invention are to be limited only the terms of the appended claims.

What is claimed is:

1. In an evaporator apparatus, especially for air-conditioning units of motor vehicles, having an evaporator assembly with several evaporator pipes and coolant supply means comprising an expansion valve, a flow divider for dividing the coolant flow, and connecting means between the expansion valve and the flow divider, said connecting means having at least one bend, the improvement comprising mixing means, disposed in the coolant flowpath directly upstream of an inlet to the flow divider, for causing gaseous and liquid components of the coolant flow to form a homogeneous mixture at said inlet to the flow divider.

2. An evaporator apparatus according to claim 1, wherein the mixing means includes a cylinder-shaped mixing cell having a diameter ($d_W$) which is larger than a diameter ($d_E$) of an entry opening for the coolant flow.

3. An evaporator apparatus according to claim 2, wherein a ratio of said diameters ($d_E/d_W$) is at least $\frac{1}{2}$ and no more than $\frac{2}{3}$.

4. An evaporator apparatus according to claim 2, wherein said entry opening is disposed on a sidewall of the mixing cell.

5. An evaporator apparatus according to claim 2, wherein the flow divider is connected directly to an opening located on the mixing cell.

6. An evaporator apparatus according to claim 5, wherein said opening for the flow divider is disposed on a sidewall of the mixing cell.

7. An evaporator apparatus according to claim 1, wherein the mixing means includes an insert having a flow cross-section which is tapered in the flow direction.

8. An evaporator apparatus according to claim 7, wherein said insert is located inside a pipe and wherein an increase in flow cross-section of the mixing means occurs at a downstream end of said insert.

9. An evaporator apparatus according to claim 7, wherein said insert is located between two pipes and wherein an increase in flow cross-section of the mixing means occurs at a downstream end of said insert.

10. An evaporator apparatus according to claim 9, wherein said insert (18) extending around its circumference, said collar being clamped between opposing ends of said pipes.

11. An evaparator apparatus according to claim 10, wherein one of said pipes is provided with an enlarged end which overlaps said collar.

12. An evaporator apparatus according to claim 1, wherein the mixing means includes a screen.

13. An evaporator apparatus according to claim 12, wherein the screen is located between opposing ends of two pipes.

14. An evaporator apparatus according to claim 13, wherein one of said pipes is provided with an enlarged end which overlaps an edge of the screen.

15. An evaporator apparatus according to claim 1, wherein said connecting means between the expansion valve and the mixing means is one of said several pipes of the evaporator assembly.

* * * * *